United States Patent [19]

Meer et al.

[11] Patent Number: 4,948,333

[45] Date of Patent: Aug. 14, 1990

[54] AXIAL-FLOW TURBINE WITH A RADIAL/AXIAL FIRST STAGE

[75] Inventors: Hans-Peter Meer, Unterbözberg; Ueli Wieland, Wettingen, both of Switzerland

[73] Assignee: Asea Brown Boveri Ltd., Baden, Switzerland

[21] Appl. No.: 372,456

[22] Filed: Jun. 28, 1989

[30] Foreign Application Priority Data

Aug. 3, 1988 [CH] Switzerland ..... 2938/88

[51] Int. Cl.[5] ..... F01D 5/00

[52] U.S. Cl. ..... 415/93; 415/101

[58] Field of Search ..... 415/93, 108, 189, 191, 415/208.1, 208.2, 182.1, 209.3, 182.1, 101, 103; 416/184, 199

[56] References Cited

U.S. PATENT DOCUMENTS

| | | | |
|---|---|---|---|
| B 563,412 | 2/1976 | Booher, Jr. et al. | 415/136 |
| 1,935,463 | 11/1933 | Wiberg | 253/16.5 |
| 2,281,631 | 5/1942 | Spillmann et al. | 415/108 |
| 3,263,963 | 8/1966 | Hanschke et al. | 415/189 |
| 3,305,165 | 2/1967 | Gregory | 415/191 |
| 3,313,517 | 4/1967 | Hanschke et al. | 253/39 |
| 3,910,716 | 10/1975 | Roughgarden et al. | 415/217 |
| 4,009,969 | 3/1977 | Kadera et al. | 415/209.3 |
| 4,053,257 | 10/1977 | Rahaim et al. | 415/214 |
| 4,076,451 | 2/1978 | Jankot | 415/217 |

FOREIGN PATENT DOCUMENTS

| | | | |
|---|---|---|---|
| 526805 | 5/1931 | Fed. Rep. of Germany | 415/101 |
| 2358160 | 4/1975 | Fed. Rep. of Germany | 415/101 |
| 2503493 | 12/1983 | Fed. Rep. of Germany | 415/101 |
| 2016189 | 5/1970 | France . | |
| 545414 | 1/1974 | Switzerland . | |

*Primary Examiner*—Robert E. Garrett
*Assistant Examiner*—Hoang Nguyen
*Attorney, Agent, or Firm*—Burns, Doane, Swecker & Mathis

[57] ABSTRACT

In an axial-flow turbine consisting essentially of an outer casing, an inner casing with a preferably integrated vane carrier (5) and a rotor (3) fitted with rotor blades (6), the first stage is designed as a radial/axial stage. It is supplied with working medium from a toroidal or spiral inlet flow housing (4). The radial vanes (10) are provided at their two ends with root plates (14) by means of which they are bladed in annular recesses (15) in the blade carrier (5). The free end faces (19) of the root plates are of curved design.

3 Claims, 3 Drawing Sheets

AXIAL-FLOW TURBINE WITH A RADIAL/AXIAL FIRST STAGE

BACKGROUND OF THE INVENTION

1. Field of the Invention

The invention relates to an axial-flow turbine, essentially consisting of an outer casing, an inner casing with a preferably integrated vane carrier and a rotor fitted with rotor blades, in which turbine the first stage is designed as a radial/axial stage, the radial vane row being supplied from a toroidal or spiral inlet flow housing.

2. Discussion of Background

The supply to axial bladings, in particular of low-pressure parts of steam turbines, can be effected by a toroidal annular space. This has the task of feeding the steam rate entering this annular space through one or more pieces of pipe to the first blade ring as uniformly as possible and with avoidance of major losses. Because of the limited number and the sometimes asymmetrical arrangement of the feed pipe branches, this is not achievable to an adequate extent. The large number of the necessary deflections of the flow, until the radial blade channel is reached, causes losses which can reach a multiple of the kinetic inflow energy in the pipe branch. For this reason, endeavors are made to minimize the mean velocities in the annular space, which lead to large dimensions of the annular space. Because non-uniform inflow to the axial blading is to be expected, a radial guide grid, which generates the spin necessary for producing power in the first rotor wheel, is therefore arranged in the radial inflow part. Such a turbine is known, for example from DE-A-No. 2,358,160.

A spiral design of the inlet flow housing, such as has been known already a long time ago in water turbines, allows an increase in the mean inflow velocity by a multiple of the values usual for toroidal inlet channels, without reaching the large losses of the latter. This is possible as a result of the fact that the flow direction which, in the inlet branch and in the spiral, is predominantly tangential in the same direction as that of the turbine rotation, can be utilized directly for producing work. The friction losses, which are also increased due to the higher velocities, are of less importance by comparison. By means of a suitable design of the cross-sections of the spiral, uniform inflow to the radial blade channel can be achieved and a radial guide grid, arranged there, will then deflect the flow only weakly and hence with low losses. Such a turbine is known, for example, from DE-A-No. 2,503,493.

To absorb forces due to different expansions during operation, the inlet flow housings are as a rule provided with reinforcing ribs or bars distributed around the periphery are provided in the radial channel upstream of the radial vane row, as can be seen in DE-A-No. 2,358,160 already quoted. It is obvious that such channels represent quite considerable flow resistances.

SUMMARY OF THE INVENTION

Accordingly, one object of this invention is to make it possible to omit the separate, force-absorbing auxiliary structures such as reinforcing ribs or reinforcing bolts in a turbine of the type described at the outset.

According to the invention, this object is achieved when the radial vanes are provided at their two ends with root plates by means of which they are bladed in in annular recesses in the blade carrier, and when the free end faces of the root plates are of curved design.

Admittedly, it is known from U.S. Pat. No. 3,313,517 to arrange a radial vane row in a double-flow turbomachine without an additional fixing element on the two 180° inflow spirals. However, this configuration is a self-supporting casing of a gas turbine in which, on the one hand, low gas pressures prevail and, on the other hand, a pressure balance with the outer casing is provided via orifices in the spirals carrying the flow. The vanes in that case can any way not fulfil a force-absorbing function, since they are designed to be adjustable, that is to say they are suspended with a gap towards the adjacent flanges. The circumstance that, according to the invention, the radial vanes also fulfil a static function in addition to their deflection function, leads to the advantage that

- on the one hand, space can be gained in the radial direction because the length of the radial-flow part of the vane carrier can be made shorter and
- on the other hand, that, in casings with a 360° inflow spiral, it becomes possible due to the omission of the usual bolts to conceive a fully integral inner casing.

To prevent buckling of the vanes under pressure loadings which arise in the case of expansions of the inlet flow housing, it is advantageous when the arcuate peripheral surfaces of the root plates of the radial vanes are dimensioned so that they have a clearance relative to the annular recesses in the blade carrier. For the purpose of defined contact of these arcuate peripheral surfaces, the root plates should then be mutually offset rotationally in the recesses. By interaction with the curved end faces of the root plates, this measure effects a locally defined line of force, which always runs inside the blade profile.

It is particularly advantageous when both root plates are provided at their arcuate peripheral surfaces with annular grooves in which teeth of the recesses engage. In addition to the well-defined guidance of the vanes, tensile forces can thereby also be introduced via the vanes into the vane carrier.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

In the various figures, the same parts are always provided with the same reference symbol. The direction of flow is always marked by arrows.

DESCRIPTION OF THE PREFERRED EMBODIMENTS

Figure 1:
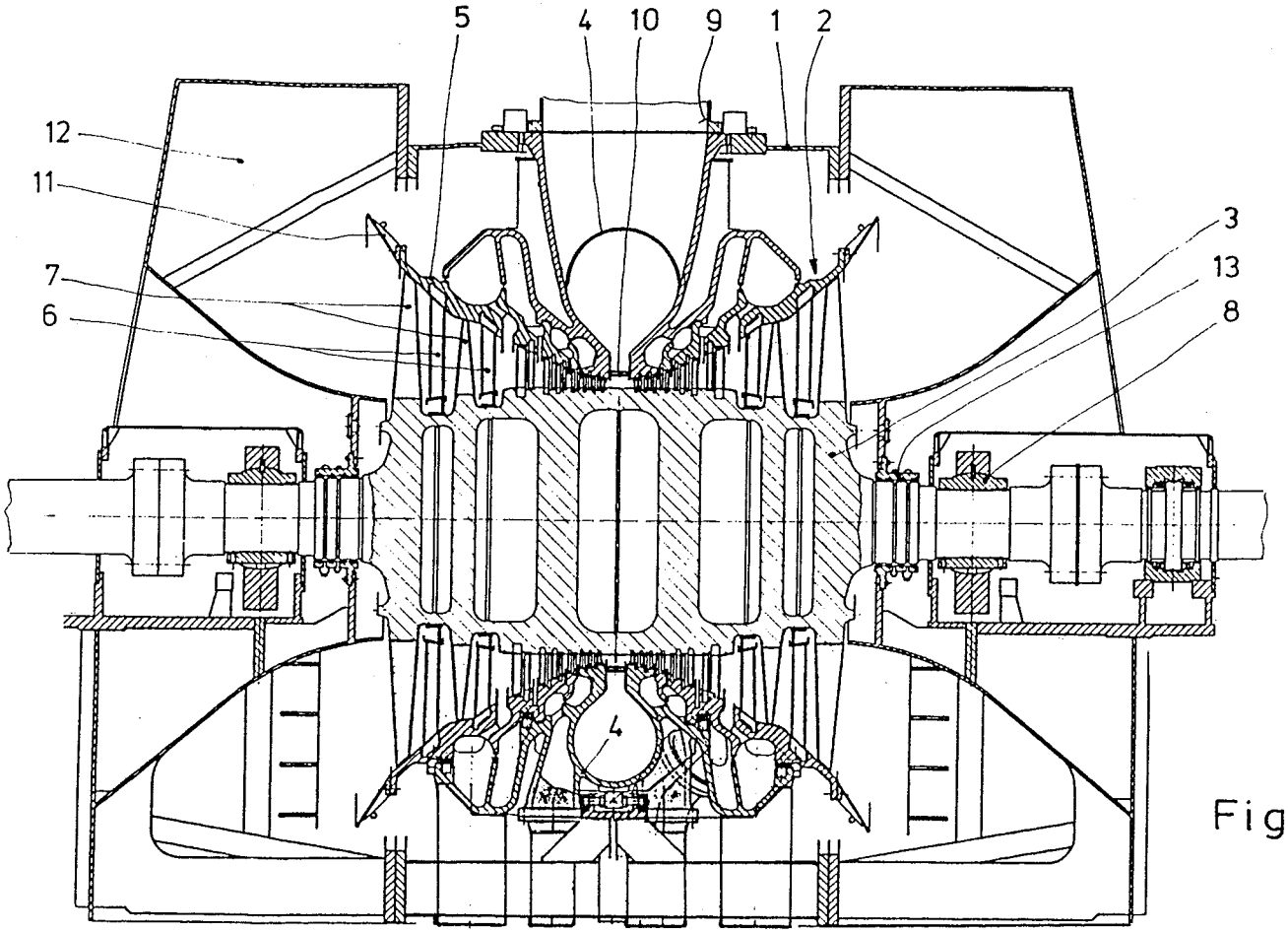
FIG. 1 is a view of a double-flow low-pressure part turbine in an axial section with a 360° inflow spiral.

In the steam turbine shown in FIG. 1, only the elements essential for understanding the mode of action are provided with reference symbols. The main components are the outer casing 1, the inner casing 2 and the rotor 3. The outer casing consists of a plurality of parts which are not marked in more detail and which, as a rule, are bolted or welded to one another only at the site of erection. The cast inner casing consists of the inlet flow housing 4 in the form a 360° spiral and the downstream vane carriers 5 which are fitted with the vanes 6. In the case shown, the vane carriers are joined to the spiral housing by bolting. As already mentioned, however, the invention also allows the possibility of producing the inner casing integrally. Integrally is here to be understood as a relative term since, of course, the spiral housing and blade carrier are divided horizontally and bolted to one another at the parting flanges which are not shown. In the plane of these parting flanges, the inner casing is supported by means of carrier arms in the outer casing.

The rotor 3 fitted with the rotor blades 7 is welded together from shaft disks and shaft ends with integrated coupling flanges. It is supported in the bearing housings 8 by means of plain bearings.

The route of the steam leads from a steam inlet line 9 via the steam passage in the outer casing 1 into the inner casing 2. The spiral ensures that steam reaches the two passes of the blading with good guidance. Optimum efficiency is achieved by the radially arranged first vane row 10. After release of the energy to the rotor 3, the steam passes via an annular diffusor 11 into the exit steam space 12 of the outer casing 1, before it flows out downwards (in the drawing) to the condenser. Axial-flow shaft seals 13 on the rotor bushing in the outer casing prevent an escape of the steam.

Figure 2:
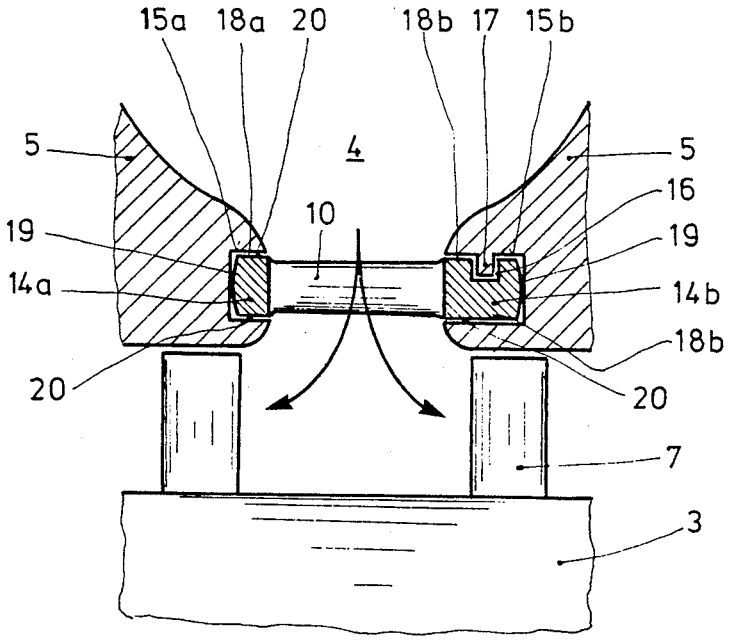
FIG. 2 is a view of a partial axial section of a first stage with the radial blades designed for compressive loadings.

FIG. 2 shows how, in a double-flow turbine, the radial vanes 10 are suspended in the radial part of the inlet flow channel 4. The blade leaf is provided at both of its ends with one root plate. The left-hand root plate **14*a* is shorter in the axial direction of the turbomachine, that is to say in the longitudinal direction of the radial blade, than the right-hand root plate 14*b*. Both root plates rest in annular recesses 15*a* and 15*b* respectively. For defined guiding, the right-hand root plates 14*b* are provided with a groove 16 in which an annular tooth 17, protruding in the recess 15*b*, engages. The peripheral surfaces 18*a* and 18*b* on the insides and outsides respectively of the lozenge-shaped root plates are milled in an arc (FIGS. 4*a*, 5*a***), the particular arc radius corresponding to the radius of the associated recess.

The free end faces 19 of the two root plates are of curved design for contact with the radial parts of the recesses. The curvature is here selected in such a way that the contact points are always located on one line which is within the blade profile. In order to ensure this under all operating conditions, a defined clearance 20 between the arcuate peripheral surfaces 18 and the corresponding walls of the recess 15 is provided. In the case of expansions, caused by the temperature, of the inlet flow housing and of the blade carriers 5 fixed thereto, the radial parts of the recesses can thus roll over the curved end faces of the root plates. The compressive stresses arising are absorbed by the blade leaf, without the latter buckling out. This is especially important in the case of a 360° spiral according to FIG. 1, since such spirals show varying expansion around the periphery. If such unhindered expansion were not allowed, for example as a result of unduly firm, clearance-free clamping of the root plates in the recesses, it would be possible for the radial vane row to be overstressed, since the flexural stress would also have to be absorbed in addition to the compressive stress.

In order then to avoid that the blades rest loosely in the recesses due to the clearance 20, the two root plates **14*a* and 14*b* are mutually offset rotationally by an angle of defined magnitude, for example 0.5°. On blading-in, this leads to definite contact of the peripheral surfaces in the recesses, as is shown over-emphasized in FIGS. 4*a* and 5*a***.

Figure 3:
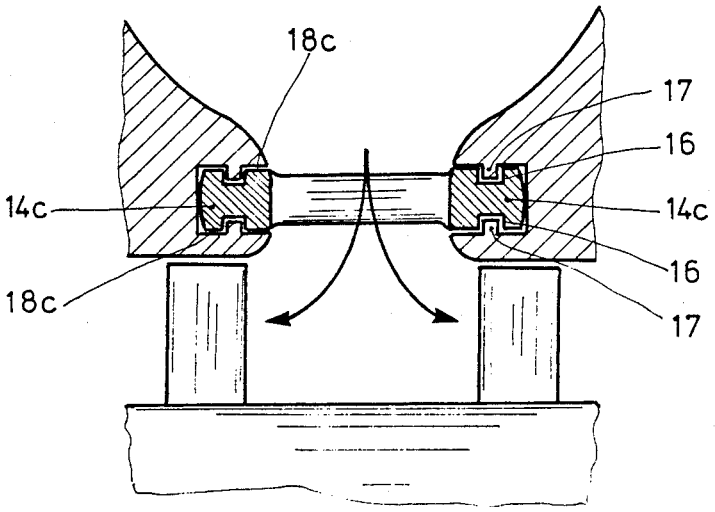
FIG. 3 is a view of a partial axial section of a first stage with the radial blades designed for compressive loading and tensile loading, FIGS. 4 and **4*a* are views of a rough sketch in front view of a toroidal inflow channel with the corresponding part view of the radial vane blading.

FIG. 3 shows a variant of the vane fixing, which is suitable for the absorption of both tensile forces and compressive forces. Identical root plates **14*c*, which are bladed in in the manner of an inverted T root, known per se, are here provided on each of the two sides of the blade leaf. The arcuate peripheral surfaces 18*c* of both the inner and outer sides of the plates are here provided with grooves 16, in which teeth 17 of corresponding dimensions in the recess 15*c*** engage.

Figure 4:
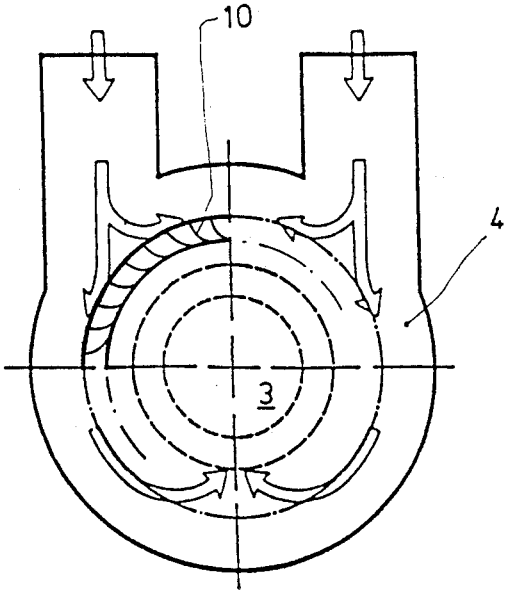
Figure 4A:
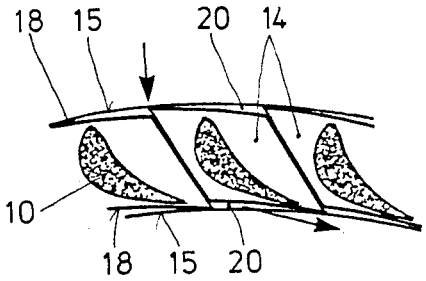

In FIG. 4, the arrangement of the radial vane row is diagrammatically shown in an annular or toroidal installation. Because of the prevailing flow conditions, a blade profile, which is relatively insensitive to the inflow direction which varies widely around the periphery, is here chosen for the vanes in accordance with FIG. **4*a***.

Figure 5:
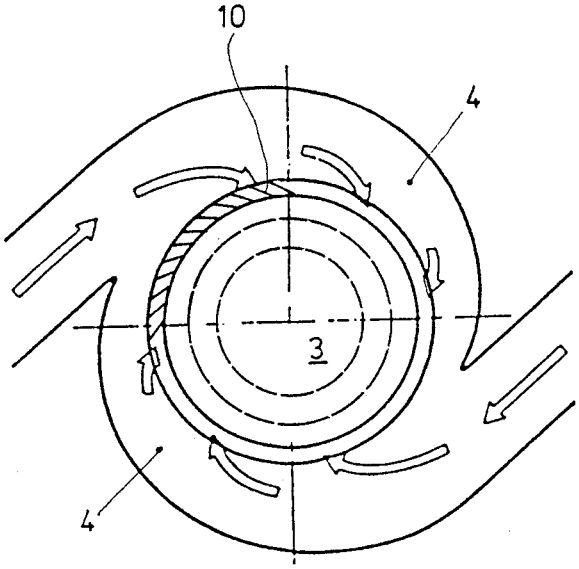
FIGS. 5 and 5*a*** are views of a rough sketch in front view of an inlet flow housing with two 180° spirals with the corresponding part view of the radial vane blading.
Figure 5A:
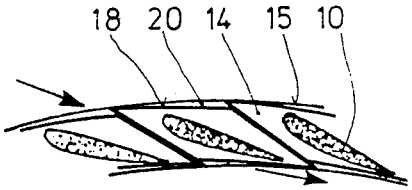

Finally, FIG. 5 shows the inflow conditions in an inlet flow housing which consists of two 180° spirals. It can be seen here that, according to FIG. **5*a***, a grid with only weak deflection and hence extremely small losses can be applied.

Obviously, the invention is not restricted to the examples shown and described, and numerous modifications and variations of the present invention are possible in the light of the above teachings. As distinct from the double-flow turbines shown in FIGS. 1 to 3, the invention can also be applied successfully to the inlet flow housings of single-flow turbines, if these are provided with a radial first vane row. It is therefore to be understood that, within the scope of the appended claims, the invention may be practiced otherwise than as specifically described herein.

What is claimed as new and desired to be secured by letters patent of the United States is:

1. An axial-flow turbine having a first stage designed as a radial/axial stage, comprising:

an outer casing, an inner casing, a vane carrier having annular recesses therein fixed to said inner casing, and a rotor fitted with rotor blades, a toroidal or spiral inlet flow housing, a radial vane row having radial vanes mounted in said vane carrier and supplied from the inlet flow housing, said radial vanes having at their two ends root plates with free end faces, said radial vanes being bladed in the annular recesses in the vane carrier by means of the root plates, and the free end faces of the root plates are of a curved design.

2. A turbine as claimed in claim 1, wherein the arcuate peripheral surfaces of the root plates of the radial vanes are dimensioned so that they have a clearance relative to the annular recesses in the vane carrier, and wherein the root plates are mutually offset rotationally in the recesses for the purpose of defined contact of these arcuate peripheral surfaces.

3. A turbine as claimed in claim 1, wherein both root plates of a vane are provided at their arcuate peripheral surfaces with grooves in which teeth in the recesses engage.

* * * * *